United States Patent [19]

Hanson

[11] Patent Number: 4,848,049

[45] Date of Patent: Jul. 18, 1989

[54] JOIST PROTECTOR

[75] Inventor: Glenn R. Hanson, Gilford, N.H.

[73] Assignee: Mold Systems Corporation, Ludlow, Mass.

[21] Appl. No.: 239,427

[22] Filed: Sep. 1, 1988

[51] Int. Cl.[4] ..... E04D 13/00; E04B 1/64; E04B 1/66

[52] U.S. Cl. ..... 52/97; 52/58; 52/105; 52/410

[58] Field of Search ..... 52/101, 105, 58, 300, 52/301, 95, 410, 97; 33/526, 527, 480

[56] References Cited

U.S. PATENT DOCUMENTS

| | | | |
|---|---|---|---|
| 494,848 | 4/1893 | Durkin | 52/101 |
| 561,409 | 6/1896 | Le Gros . | |
| 1,689,320 | 3/1926 | Bradbury . | |
| 2,242,266 | 2/1940 | Scales . | |
| 2,674,765 | 11/1950 | Tennison . | |
| 2,859,486 | 11/1958 | Rovich | 52/410 |
| 2,861,525 | 11/1958 | Curtis et al. . | |
| 4,071,994 | 2/1978 | Ammann . | |
| 4,644,720 | 2/1987 | Schneider . | |
| 4,742,654 | 5/1988 | Cole | 52/101 |

*Primary Examiner*—John E. Murtagh
*Attorney, Agent, or Firm*—Jones, Tullar & Cooper

[57] ABSTRACT

A joist protector which is placeable between a joist and a plurality of planks prevents water from entering the joist through nail holes or cracks. The joist protector has a generally planar central web and downwardly angled side flanges. A plurality of spaced water deflectors and interspersed deck planking spacers may be formed on the central web.

5 Claims, 1 Drawing Sheet

FIG. 1
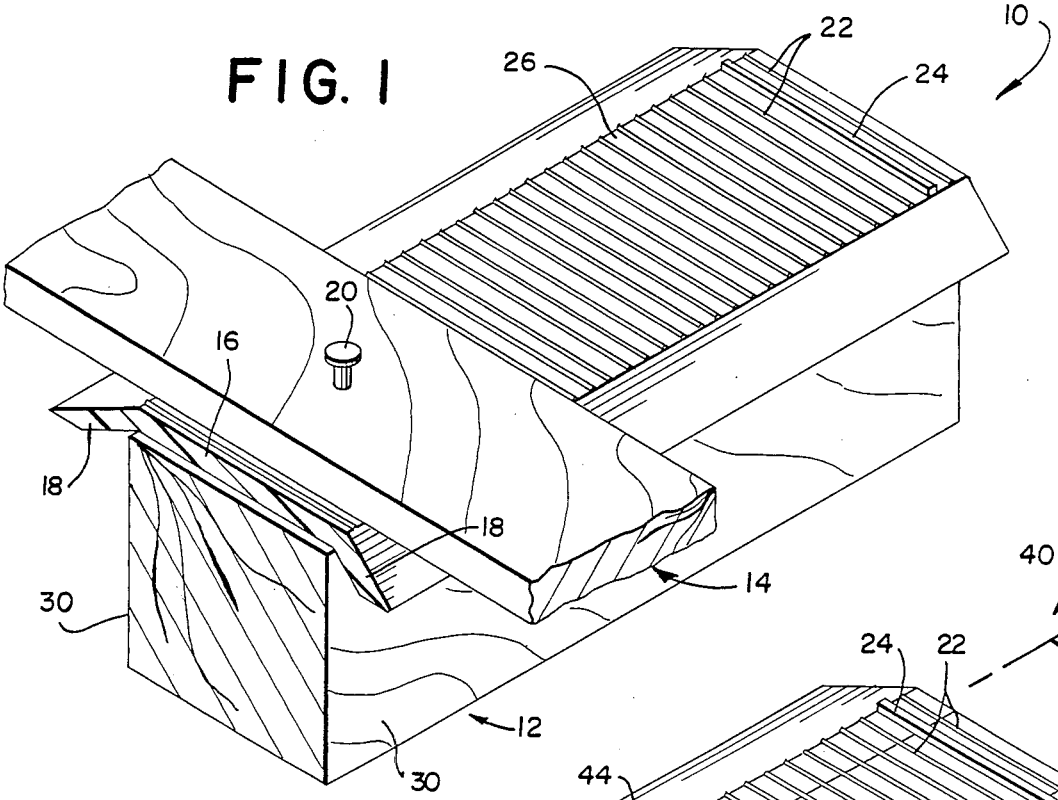
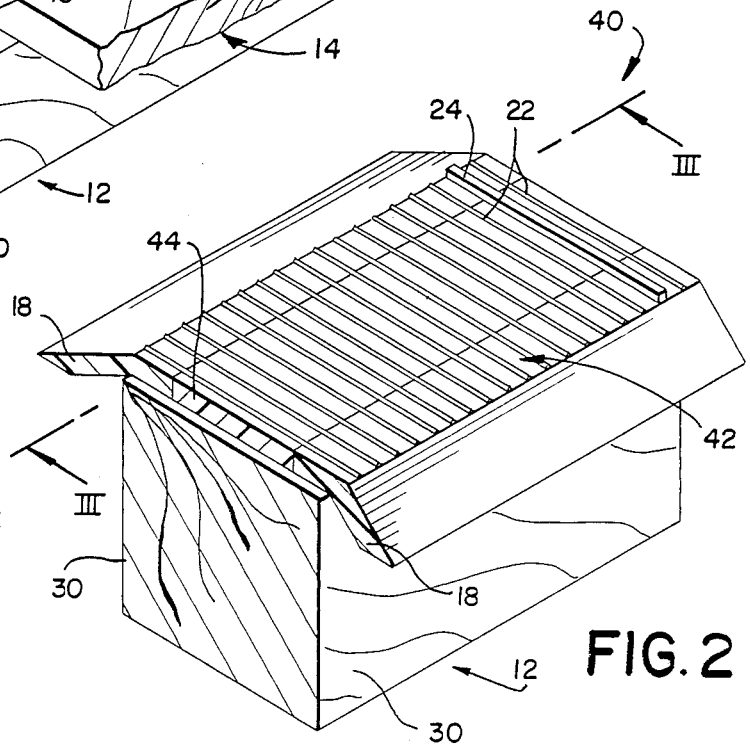
FIG. 2
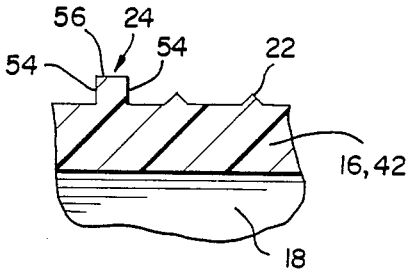
FIG. 5
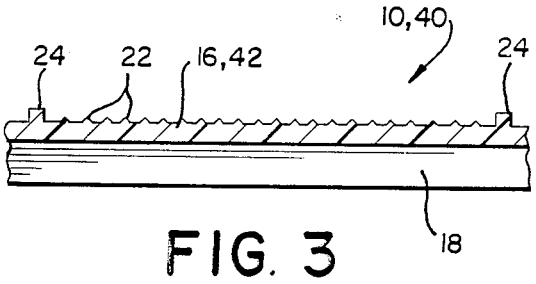
FIG. 3
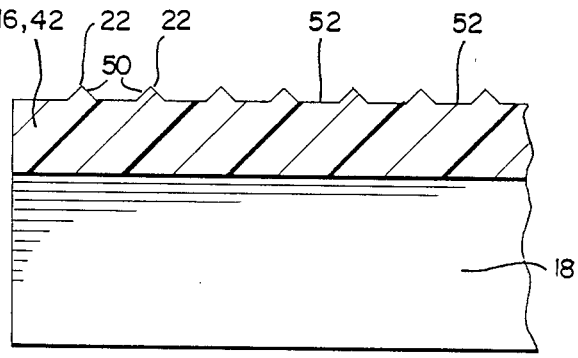
FIG. 4

JOIST PROTECTOR

FIELD OF THE INVENTION

The present invention is directed generally to a joist protector. More particularly, the present invention is directed to an extruded plastic or rubber joist protector. Most specifically, the present invention is directed to a plastic joist protector having water deflectors and decking spacers. The plastic joist protector is useable primarily with exterior construction, such as wooden decks, patios and the like. The protector is placed atop the wooden joists and beneath the deck planking to form a barrier which prevents entry of water into nail holes or cracks in the joists to thereby significantly extend the life of these joists.

DESCRIPTION OF THE PRIOR ART

Wooden decks and patios have enjoyed increasing popularity in recent years as an adjunct to homes and in various municipal parks, recreational areas and the like. Additionally, there has been a trend to the inclusion of porches on recently constructed homes. Further, the utilization of elevated wooden bicycle paths, nature trails and other similar exterior wooden structures has also increased markedly in recent years. These wooden exterior structures are typically constructed using either untreated lumber, which may subsequently be painted or stained, or using so-called pressure treated or salt treated materials.

In the course of time in wooden deck and similar construction which is exposed to the elements, water enters the joints through nail holes and starts to rot the wood. Even in pressure treated joists, the treating material often does not permeate throughout the wood so that water which enters into the core of the joists will start the process of rotting which, in time will cause the nails used to secure the deck planking in place to lose their grip. Eventually,. this water damage may lead to the complete deterioration of the joists so that it will have to be replaced.

Exterior decks and patios as well as walkways and raised bridges are frequently constructed with the deck plankings being spaced slightly apart from each other. This provides an open appearance which is quite popular and which also allows rain water, melting snow and the like to run off the deck and away through these spaces. Frequently during construction of the deck, the spacing of the deck planks is done by eye or by using a crude spacing scheme, such as by spacing adjacent planks the width of a nail shank. This clearly results in non-uniform spacing which is apt to reduce the overall appearance of the structure.

It will thus be seen that there is a need for a joist protector which will overcome the problems inherent with typical construction procedures, as discussed above. The joist protector in accordance with the present invention provides such a device and is a significant advance in the art.

SUMMARY OF THE INVENTION

It is an object of the present invention to provide a joist protector.

Another object of the present invention is to provide a plastic joist protector.

A further object of the present invention is to provide a joist protector which has integral deck planking spacers.

Yet another object of the present invention is to provide a joist protector having spaced water deflectors.

Even a further object of the present invention is to provide a joist protector having a central nailing strip.

Still yet another object of the present invention is to provide an extruded plastic joist protector.

As will be discussed in greater detail in the description of the preferred embodiments which is set forth subsequently, the joist protector of the present invention is useable to shield the upper surface of wooden joists and to prevent water from entering the joist through nail holes, cracks and the like. The joist protector is made of one or more plastic compositions which may be extruded or otherwise formed in various lengths. The joist protector includes a generally planar central web with opposed, downwardly inclined side flanges. A plurality of raised water deflectors may extend transversely across the upper surface of the joist protector as may suitably spaced planking spacers. The joist protector may be extruded of a single plastic material or may be formed having a central, more flexible nailing strip which is co-extruded with spaced, more rigid plastic side portions.

The joist protector of the present invention is used by placing it atop the joists before the dect planks are put down. The two side flanges slope outwardly and downwardly while the planar central web overlies the upper surface of the joist. The deck planks are then put in place and are nailed down in a conventional manner. Since the joist protector is made using a resilient material such as plastic, the nails will pass through the protector and into the joist. In the embodiment which uses a central nailing strip in the planar web of the joist protector, there may be used a plastic material which will essentially be self-sealing to even more fully prevent entry of water into nail holes in the joists.

The joist protector of the present invention may be formed having suitably spaced deck planking spacers which are generally parallel to the water deflector and which may be spaced in accordance with popular deck planking widths. These deck planking spacers extend up from the upper surface of the generally planar central web of the joist protector. These serve as an accurate spacing system so that the deck planks will be uniformly and consistently spaced as the deck or the like is being built.

The joist protector in accordance with the present invention may be molded from a variety of plastics which are well suited for outdoor useage. These plastics may have a colorant added which will match or complement the natural color of the wood or various paints and deck stains. The joist protector in accordance with the present invention provides deck joist protection, is easy to use, and can be installed quickly during construction. As will be appreciated, it is a substantial advance in the art.

BRIEF DESCRIPTION OF THE DRAWINGS

While the novel feature of the joist protector in accordance with the present invention are set forth with particularlity in the appended claims, a full and complete understanding of the invention may be had by referring to the detailed description of preferred embodiments, as is set forth subsequently, and as illustrated in the accompanying drawings, in which:

FIG. 1 is a perspective view of a first preferred embodiment of a joist protector in accordance with the present invention and showing the joist protector in use;

FIG. 2 is a perspective view of a second preferred embodiment of the joist protector in place atop a joist;

FIG. 3 is a sectional side elevation view of the joist protector taken along line III—III of FIG. 2;

FIG. 4 is an enlarged sectional view of a portion of the joist protector and showing the water deflectors; and FIG. 5 is an enlarged sectional view of another portion of the joist protector and showing the deck planking spacers.

DESCRIPTION OF THE PREFERRED EMBODIMENTS

Referring initially to FIG. 1, there is shown, generally at 10, a first preferred embodiment of a joist protector in accordance with the present invention. Joist protector 10 is depicted in a use position atop a deck joist, generally at 12 to which is being secured one of what will be understood by those of skill in the art a number of decking planks, generally at 14. While the joist portector of the present invention will be discussed hereinafter in conjunction with a deck, it will be understood that its useage is not limited solely to decks. The joist protector of the present invention is useable in any construction in which wooden members are nailed, bolted, or screwed to underlying joists.

As may be seen in FIG. 1, joist protector 10 has a generally planar central web 16 which is bounded by opposed, downwardly inclined side flanges 18. In the first preferred embodiment depicted in FIG. 1, joist protector 10 is fabricated from a somewhat rigid, yet resilient material such as polyvinyl chloride or a rubber having an ultraviolet stabilizer for long life in outdoor conditions. While the material is adequately rigid to provide the side flanges 18 with sufficient stiffness so that they do not sag down onto the sides of joist 12, it will be understood that the material will not split or splinter as a nail 20 is driven through it to secure deck plank 14 to joist 12.

Planar central web 16 of joist protector 10 may have; as is depicted schematically in FIG. 1, and as may be seen more clearly in FIGS. 3–5, a plurality of transversely extending water deflectors 22 and interspersed deck planking spacers 24 which are formed on an upper surface 26 of central web 16. These will be discussed in detail shortly. The width of central web portion 16 is selected to be slightly greater than that of the width of joist 12 with which the joist protector will be used. For example, with a joist having a normal 2 inch width, or an actual width of $1\frac{5}{8}$ inch, the width of planar web 16 will be generally about $1\frac{7}{8}$ inch. The length of joist protector 10 can be one of several convenient lengths to match typical joist lengths, i.e., 8, 10, or 12 feet. Joist protector 10 is easily cut to length by using conventional tools. The thickness of joist protector 10 may be generally about 0.080 inch.

Side flanges 18 of joist protector 10 are formed coextensively with central web 16 and, in the preferred embodiments, are inclined downwardly from the horizontal at an angle of generally about 30°. As discussed above, the material selected for joist protector 10 has sufficient rigidity so that these side flanges will stand away from the sides 30 of joist 12. Thus any water which runs off the central web 26 of joist protector 10 will not run down the joist sides 30. The side webs 18 increase the overall width of joist protector 10 to generally about $2\frac{7}{8}$ inch for a nominally 2 inch joist. It will again be understood that these dimensions are somewhat exemplary and will vary with the width of joist 10.

A second preferred embodiment, generally at 40, of the joist protector in accordance with the present invention is depicted in FIG. 2. Both first and second embodiments 10 and 40 are similar in overall shape and useage and similar numerals are used in both drawings for corresponding parts, where appropriate. While the central web 16 of first joist protector 10 is formed of a single material, the central web 42 of second preferred embodiment 10 has a center nailing strip 44 which extends the length of central web 42 and which, in the preferred embodiment, has a width of generally about 1 inch. This second preferred embodiment 40 can be formed by co-extruding two polyvinyl chlorides of differing hardness. The center nailing strip 44 is the softer of the two and is effectively self-sealing around nails 20 which pass through it into the joist 12. The balance of the central web 40 and the opposed side flanges 18 have sufficient rigidity to prevent the side flanges 10 from sagging down onto the sides 30 of joist 12. Central web 42 of second preferred embodiment 40 of the joist protector may also be provided with transverse water deflectors 22 and deck planking spacers 24 in a manner similar to first preferred embodiment 10.

Turning now primarily to FIGS. 3–5, the structure and function of water deflectors 22 and deck planking spacers 24 will be discussed in detail. It will be understood that the deflectors 22 and spacers 24 are equally useable with either first or second preferred embodiments 10 or 40 and that the discussion hereinafter is appropriate for both. Water deflectors 22, as seen most clearly in FIG. 4 are generally triangular in shape and have upwardly inclined side walls 50 which are inclined at an angle of generally about 45 to the horizontal. These water deflectors extend upwardly about 0.010 inch above the surface the central web and are spaced generally about $\frac{1}{8}$ inch apart. It will be understood that in use, these water deflectors 22 form parallel water channels 52 which channel water out to the edges of the central planar web 16 or 42 so that it will flow down the side flanges 18.

Deck planking spacers 24, as may be seen in FIG. 3 are generally parallel to water deflectors 22 and also extend transversely across the central web 16 or 42. These deck planking spacers 24 may be seen most clearly in FIG. 5 and have generally vertical side walls 54 and a generally planar top surface 56. These side walls 54 have heights of generally about 0.030 inch, which is also the width of planar top surface 56. As will be readily apparent, the longitudinal spacing of these deck planking spacers 24 will be one of several standard widths of conventionally used decking plank 14. As discussed above, the purpose of these deck planking spacers 24 is to provide a guide so that planks 14 nailed or otherwise secured to spaced joists 12 will be uniformly spaced.

In use during the construction of a deck, patio or other wooden structure, the joists 12 are placed in any conventional manner. The joist protector of either embodiment 10 or 40 is then placed on the upper surface of each joist and is cut as needed to be generally the same length as the joist. Now the deck planks 14 are put in place on top of the joist protector 10 or 40 with the deck spacers 24 serving to accurately and uniformly space the planks 14. As the planks 14 are put down, they are secured in place by suitable fasteners, such as nails 20. These fasteners pass through the central web of the joist protector, and in the second embodiment 40 through the center nailing strip 44. In either instance, the nail 20 does not split or break the joist protector which thus acts to prevent ingress of water into the nail hole formed in joist 12 by nails 20. Any water which contacts the joist protector will be directed by water deflectors 22 into the water channels 52 and will run off so it does not stand on the joists 12.

The joist protector in accordance with either of the preferred embodiments of the present invention prolongs deck life at a small cost. It is easily put in place during construction, requires no additional tools or equipment, and will not itself rot or deteriorate. It can be colored to match the wood and is very unobtrusive in use. While two preferred embodiment of the joist protector in accordance with the present invention have been fully and completely set forth hereinabove, it will be apparent to one of skill in the art various changes in, for example the specific type of plastic materials used, the particular lengths of the strips, and the like could be made without departing from the true spirit and scope of the invention which is accordingly to be limited only by the following claims.

What is claimed is:

1. A joist protector positionable between an upper surface of a joist and a plurality of decking planks fastenable to the joist, said joist protector comprising:

an elongated generally planar resilient central web, said central web having a lower surface which is positionable on, and extending along the upper surface of the joist;

a plurality of spaced, transversely extending deck planking spacers formed on, and projecting upwardly from an upper surface of said central web;

a plurality of spaced, transversely extending water deflectors formed on, and projecting upwardly from said upper surface of said central web between adjacent ones of said deck planking spacers, adjacent ones of said water deflectors defining water channels, said deck planking spacers, each projecting upwardly from said upper surface of said central web to a height greater than each of said water deflectors; and opposed resilient side flanges, said side flanges being joined to said central web and extending downwardly and outwardly from said central web, said side flanges having sufficient stiffness to stand away from side surfaces of the joist.

2. The joist protector of claim 1 wherein each of said water deflectors is generally triangular in cross section.

3. The joist protector of claim 1 wherein each of said deck planking spacers is generally rectangular in cross section.

4. The joist protector of claim 1 wherein said central web has a longitudinally extending center nailing strip, said center nailing strip being more resilient than the remainder of said central web and said side flanges.

5. The joist protector of claim 4 wherein said center nailing strip and said remainder of said central web and said side flanges are co-extruded from polyvinyl chlorides having different hardnesses.

* * * * *